US010515522B2

(12) United States Patent
Sankey

(10) Patent No.: US 10,515,522 B2
(45) Date of Patent: Dec. 24, 2019

(54) SYSTEM AND METHOD FOR ADAPTIVE WAYFINDING

(71) Applicant: Mark S. Sankey, Washington, PA (US)

(72) Inventor: Mark S. Sankey, Washington, PA (US)

( * ) Notice: Subject to any disclaimer, the term of this patent is extended or adjusted under 35 U.S.C. 154(b) by 0 days.

(21) Appl. No.: 16/169,940

(22) Filed: Oct. 24, 2018

(65) Prior Publication Data

US 2019/0251805 A1 Aug. 15, 2019

Related U.S. Application Data

(60) Provisional application No. 62/630,628, filed on Feb. 14, 2018.

(51) Int. Cl.

| | |
|---|---|
| ***G08B 5/22*** | (2006.01) |
| ***G09F 9/33*** | (2006.01) |
| ***G08B 5/36*** | (2006.01) |
| ***H05B 33/08*** | (2006.01) |
| *G08B 7/06* | (2006.01) |

(52) U.S. Cl.

CPC ..... *G08B 5/36* (2013.01); *H05B 33/0872* (2013.01); *G08B 7/066* (2013.01)

(58) Field of Classification Search

CPC ..... G08B 5/36; G08B 7/066; H05B 33/0872
USPC ..... 340/815.45
See application file for complete search history.

(56) References Cited

U.S. PATENT DOCUMENTS

| | | | | |
|---|---|---|---|---|
| 7,579,945 | B1 | 8/2009 | Ritcher | |
| 7,626,507 | B2 | 12/2009 | LaCasse | |
| 9,672,717 | B1 * | 6/2017 | Slavin | G08B 21/18 |
| 9,681,280 | B2 | 6/2017 | Balthasar | |
| 2003/0234725 | A1 * | 12/2003 | Lemelson | G08B 7/066 340/521 |
| 2010/0013658 | A1 * | 1/2010 | Chen | G09F 13/04 340/815.4 |
| 2011/0161239 | A1 | 6/2011 | Muehlmeier | |
| 2013/0120137 | A1 | 5/2013 | Lehmann | |
| 2013/0169430 | A1 * | 7/2013 | Shook | G08B 17/10 340/539.1 |
| 2014/0266684 | A1 * | 9/2014 | Poder | G08B 25/003 340/521 |
| 2014/0344002 | A1 | 11/2014 | Muehlmeier | |

(Continued)

FOREIGN PATENT DOCUMENTS

| | | |
|---|---|---|
| CN | 103170071 | 6/2013 |
| CN | 105957281 | 9/2016 |

(Continued)

*Primary Examiner* — Tanmay K Shah
(74) *Attorney, Agent, or Firm* — Tucker Arensberg, P.C.

(57) ABSTRACT

A method for providing dynamic information in real time regarding weather conditions, emergency situations, navigational cues, and location-specific alerts. Informational data sets are collected from a plurality of different sensors, which are affixed to a location of interest, and received at a processor that interprets the informational data sets to generate a set of lighting commands. The lighting commands are transmitted to a lighting control system that is operably coupled to the lighting system of the location of interest. The lighting system in the location of interest is activated in a lighting pattern based on the lighting commands to covey the information contained in the informational data sets to the individuals in the location of interest.

13 Claims, 13 Drawing Sheets
(11 of 13 Drawing Sheet(s) Filed in Color)

(56) References Cited

U.S. PATENT DOCUMENTS

| | | | | |
|---|---|---|---|---|
| 2016/0123741 | A1 | 5/2016 | Mountain | |
| 2016/0255697 | A1* | 9/2016 | Bhide | H02J 9/06 315/161 |
| 2017/0103491 | A1 | 4/2017 | Bora | |
| 2018/0365942 | A1* | 12/2018 | Molloy | G06F 3/0481 |

FOREIGN PATENT DOCUMENTS

| | | |
|---|---|---|
| CN | 106455185 | 2/2017 |
| EP | 2592606 | 11/2011 |
| FR | 2829607 | 9/2001 |

* cited by examiner

SYSTEM AND METHOD FOR ADAPTIVE WAYFINDING

CROSS REFERENCE TO RELATED APPLICATIONS

This application claims priority under 35 U.S.C. § 119(e) to U.S. Provisional Patent Application No. 62/630,628, filed on Feb. 14, 2018, entitled "System for Advanced Wayfinding Lighting Control and Method for Use Thereof," which is hereby incorporated by reference in its entirety.

BACKGROUND

Alarm systems of the prior art rely on one-time triggering mechanisms whereby the alarms are sounded upon the detection of an emergency event and then only turned off by authorized individuals when they have determined that the emergency has been resolved. These alarm systems are generic in nature, sounding the same alarm for a host of different types of emergencies. The generic nature of these alarms lead to additional stress and confusion during an emergency because the generic alarms fail to provide individuals with any meaningful information. The alarms merely alert the individuals that an emergency is occurring but provide no instruction as to the safest action to take (shelter in place, exist via a practiced route, or exit via a revised route based the location of the emergency). Further, generic alarms are often ineffective in alerting individuals who are hearing impaired or have other disabilities. Even if the alarms are configured with flashing lights, these lights are typically focused in one area of a large location and may not be sufficient in getting an individual's attention because they commonly use only white lights which are indistinguishable from ambient lights.

Other alarm systems of the prior art are designed to convey emergency information to an individual's mobile phone or to an electronic display or other signage present at a location of interest. Such a configuration has significant limitations. First, not all individuals will have access to a mobile phone in the event of an emergency. For example, students in school, patients in a hospital, or residents of long-term care facilities are often targets of emergency situations and do not have easy access to mobile devices. Alarm systems that are dependent on mobile devices are therefore ineffective in addressing emergencies among a population's most vulnerable individuals.

Alarm systems that rely on electronic displays or other signage are equally ineffective. These systems require significant construction cost and time because the various displays must be fabricated and installed. These displays must be large in size and obvious in nature so that individuals will be able to read the information in the event of an emergency. The larger the displays, the more space is lost which is not practical at smaller locations such as classrooms or hospital rooms. Further, the obvious nature of the displays means that they can be easily disabled by a threat actor during an emergency, just like traditional alarm systems are easily disabled, rendering them completely ineffective.

Other alarm systems of the prior art utilize ambient lighting in an attempt to map an exit route for individuals during an emergency. This use of ambient lighting presents the same disadvantages as generic alarm systems in that ambient lighting is incapable of providing any meaningful information about the nature of the particular emergency.

Further, the use of ambient lighting is not sufficiently noticeable in the event of an emergency because individuals are conditioned to seeing it.

There exists a need for an alarm method that can not only alert individuals of an emergency, but also provide meaningful information about the specific nature of the emergency and instructions as to how to respond. It is critical that this alarm method be adaptable to enable the dissemination of critical information in a variety of different environments and to a variety of different individuals. The alarm method should also be capable of providing dynamic, real-time information that can be continuously updated as the status of the emergency changes.

SUMMARY OF THE INVENTION

The present disclosure provides for a system and method of adaptive wayfinding which can be implemented at a location of interest to provide dynamic, real-time information to individuals who are present. The method comprises receiving, at a processor, a first informational data set from at least one sensor, wherein each sensor is configured to collect information about a location of interest and wherein the information contained in the first informational data set relates to at least one of: a weather condition, an emergency situation, a navigational cue, and a location-specific alert. The first informational data set is interpreted to thereby generate a first set of lighting commands. The first set of lighting commands are transmitted to a lighting control system which is operably coupled to the lighting system of the location of interest. The lighting system of the location of interest may then be activated in a first lighting pattern based on this first set of lighting commands. This activation conveys the information contained in the first informational data set to individuals present at that location.

The method then enables providing additional information and real-time updates to the individuals present in the location by receiving, at the processor, a second informational data set from at least one sensor. Again, each sensor is configured to collect information about the location of interest and the second informational data set also contains information related to at least one of: the weather condition, the emergency situation, the navigational cue, and the location-specific alert. This second informational data set may be collected and received by the processor at a point in time that is later than the point in time the first informational data set was collected. The second informational data set may be interpreted to thereby generate a second set of lighting commands, which may be a modified set of lighting commands. This second (or modified) set of lighting commands is then transmitted to the lighting control system to activate the lighting system of the location of interest in a second (or modified) lighting pattern. This second (or modified) lighting pattern conveys additional, real-time information to the individuals present in the location of interest. This information may comprise a change in status of at least one of: the weather condition, the emergency situation, the navigational cue, and the location-specific alert.

A system of the present disclosure may comprise at least one sensor that is configured to collect at least one informational data set about a location of interest. A processor may be configured to receive the informational data sets and interpret each informational data set to thereby generate a least one set of lighting commands, wherein the information contained in the data set further comprises at least one of: a weather condition, an emergency situation, a navigational cue, and a location-specific alert. A lighting control system may be configured to receive each set of lighting commands and at least one signal processor may be configured to receive each set of lighting commands form the control system and execute each such command to activate a lighting system in the location of interest. The lighting system may be activated in a number of different lighting patterns depending on the specifics of the location, number of exits, number of sensors, and information being conveyed.

The system and method of the present disclosure is advantageous over the prior art because (1) it utilizes dynamic, real-time information from multiple sensor sources, (2) it uses different lighting patterns and colors to provide specific information about the nature of the emergency, (3) it does not require any specialized displays or signage, (4) it can provide a safe means for exiting the location which is based on knowledge of the location of the particular emergency, (5) it can display a variety of different messages by activating different lighting displays, (6) it does not rely on individuals having a mobile device or installing additional displays or signage at a location, and it can provide an effective means of alerting individuals with hearing impairments and other disabilities in the event of an emergency.

BRIEF DESCRIPTION OF THE DRAWINGS

The accompanying drawings, which are included to provide further understanding of the disclosure and are incorporated in and constitute a part of this specification, illustrate embodiments of the disclosure and, together with the description, serve to explain the principles of the disclosure. The patent or application file contains at least one drawing executed in color. Copies of this patent or patent application publication with color drawing(s) will be provided by the Office upon request and payment of the necessary fee.

DETAILED DESCRIPTION

Reference will now be made in detail to the embodiments of the present disclosure, examples of which are illustrated in the accompanying drawings. Wherever possible, the same reference numbers will be used throughout the drawings to refer to the same or like parts.

The present disclosure provides for a system and method for adaptive wayfinding which can be applied in a wide-variety of different locations to provide dynamic, real-time information to individuals at a location of interest. Examples of these locations include, but are in no way limited to: an airport, a subway system, a ground transportation terminal, a port, a theater, a sports venue, a school, an office building, a hospital, a long term care facility, physician offices, a day care, religious buildings, a government building, and a shopping mall.

Figure 1:
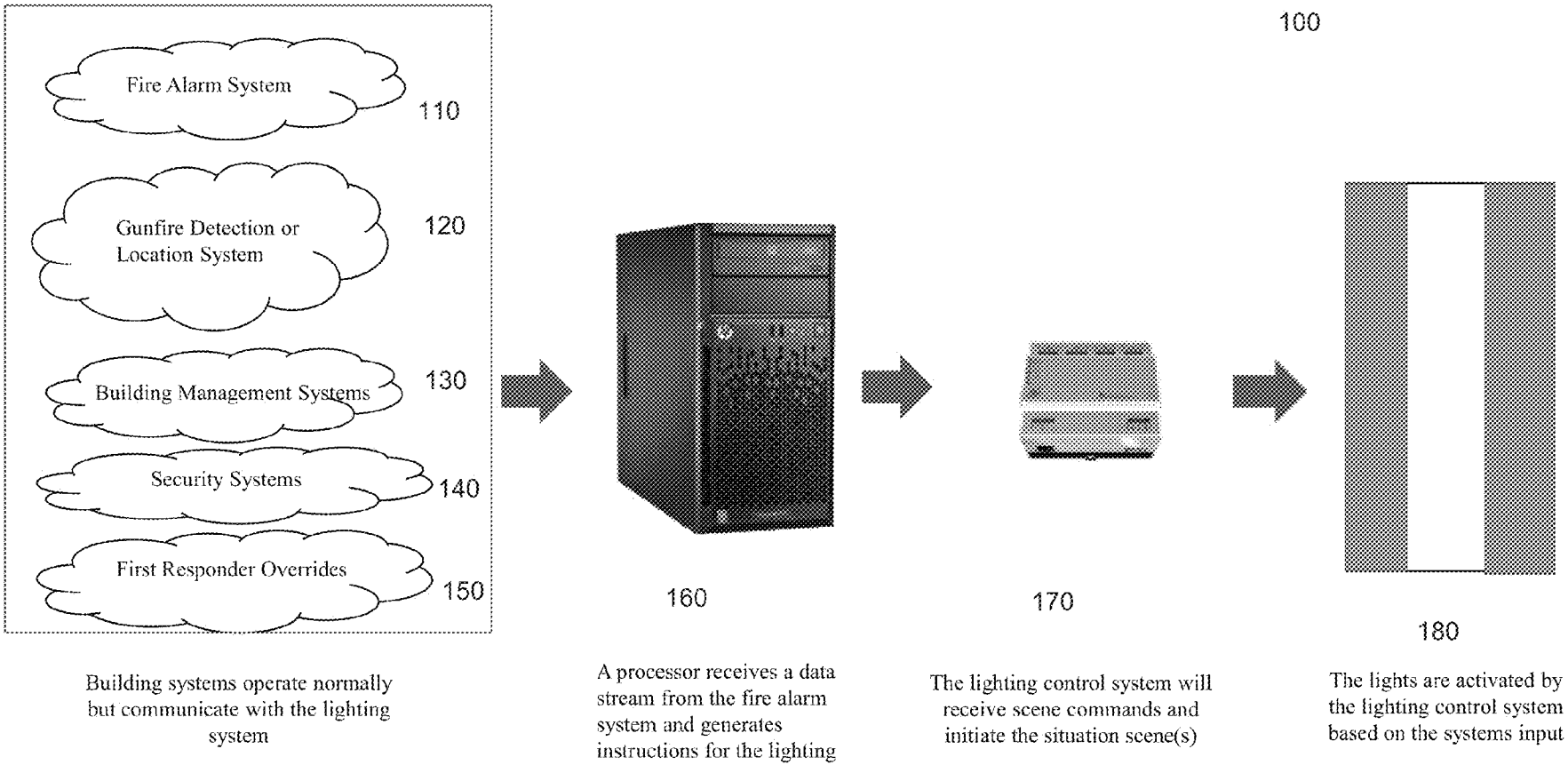
FIG. 1 is illustrative of the flow of data and information as contemplated by the present disclosure.

FIG. 1 provides a high-level overview 100 of a method of the present disclosure. At a high-level, the method of FIG. 1 provides for leveraging a plurality of building systems to collect information about a location of interest. As illustrated in FIG. 1, these building systems may comprise a fire alarm system 110, a gunfire detection or location system 120, a building management system 130, a security system 140, and first responder overrides 150, which are described in more detail below. The information collected is transmitted to a processor 160 and then to a lighting control system 170. Lights present at the location of interest may then be activated based on the systems input 180.

Figure 2:
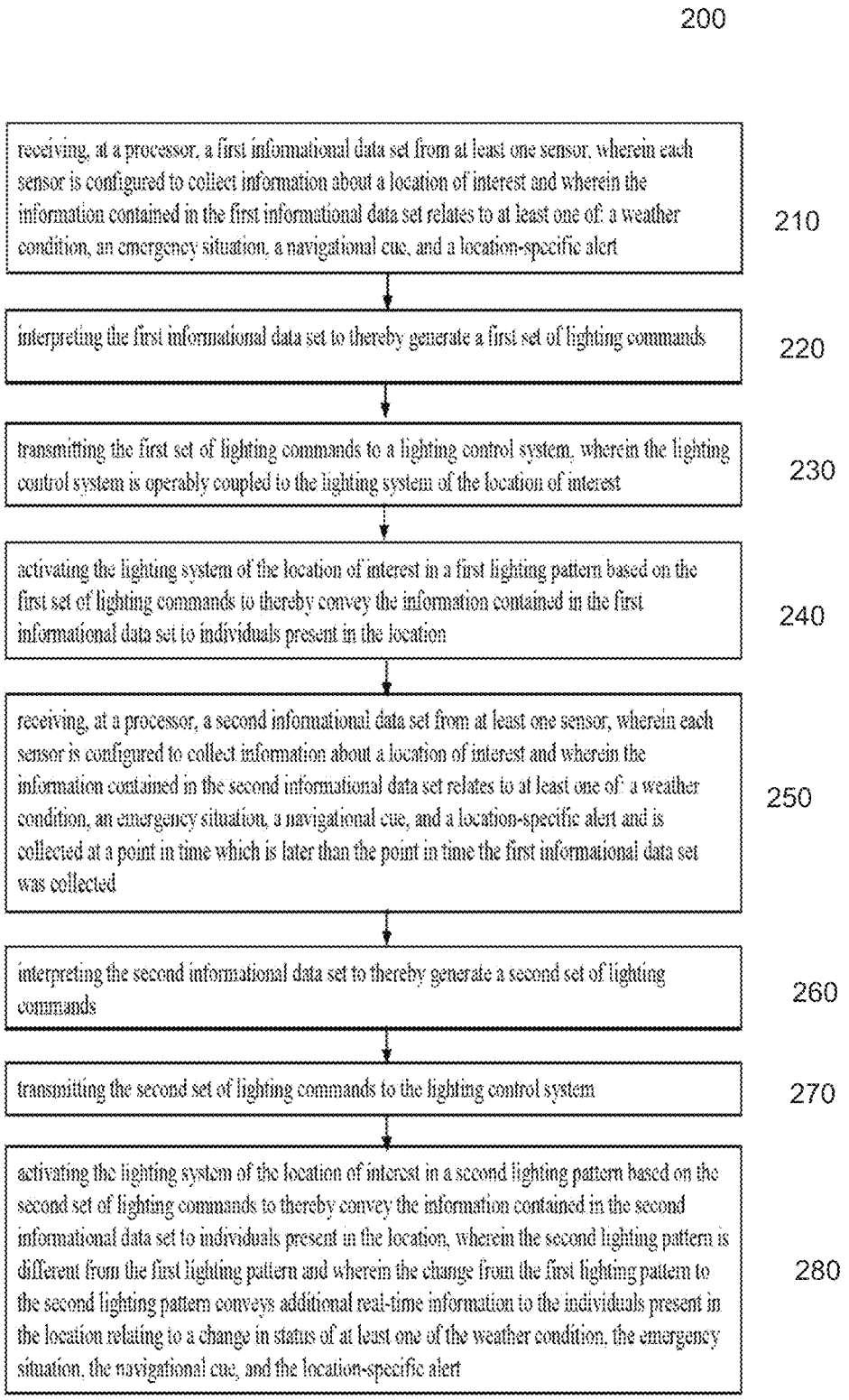
FIG. 2 is illustrative of the flow of data and information as contemplated by the present disclosure.

This method is described in more detail in FIG. 2. Here, the method 200 may comprise receiving, at a processor, a first informational data set from at least one sensor in step 210. These sensors are configured to collect information about the location of interest and may comprise sensors already installed at various points throughout the location. For example, the sensors may include, but are not limited to at least one of: a security system, a fire alarm system, a building management system, a paging system, elevator controls, motion detectors, threat detectors, metal detectors, luggage scanners, body scanners, thermostats, HVAC control panels, and computer networks. In one embodiment, the automatic collection of information from these sensors may be combined with or overridden by manual inputs by first responders or other authorized individuals who are present at the location. This combination of automatically collected information and manually input information enables the information being conveyed to be updated in real-time based on visual or other observations of authorized individuals on scene.

The first informational data set collected may relate to at least one of: a weather condition, an emergency situation, a navigational cue, and a location-specific alert. Examples of weather conditions may include routine updates on normal weather conditions such as fog, rain, or snow and also updates on extreme weather conditions related to natural disasters, winter storms, or heavy flooding. Emergency situations may include active shooters, fire, security breaches, or medical emergencies. Navigational cues may include instructions to individuals as to what the safest course of action is in a given scenario. For example, certain navigational cues may be configured to instruct the individuals to shelter in place or to evacuate the location. In the event evacuation is determined to be the safest course of action, the navigational cue may also comprise directional cues, presented in a dynamic manner, to assist individuals finding the safest exist route. Since the method is collecting information from specific sensors, the location of a given threat will be known and an exit route can be adjusted to avoid the threat. This flexibility is advantageous over the prior art because it means that the method is adaptable and that individuals are not confined to one predetermined means of exit. This adaptability is important because by providing an exit route that avoids the treat, more individuals may safely exit the location in a more efficient manner with less disorder and panic.

Location-specific alerts may comprise a wide variety of different types of information depending on the location of interest. For example, as seen in FIGS. 9-13, when the method is deployed in an airport, the location-specific alerts may provide value information to passengers navigating through the airport. This example is discussed in more detail below in connection with the description of FIGS. 9-13. In another example, where the method is deployed in a hospital or long term care facility, the location-specific alert may indicate those rooms where patients or residents cannot evacuate on their own and need assistance from first responders or other authorized individuals to exit the location. In theaters and stadiums location-specific alerts may indicate when a performance or sporting match is about to begin or to signal breaks in the action.

Referring again to FIG. 2, this first informational data set may be interpreted in step 220 to thereby generate a first set of lighting commands which are transmitted in step 230 to a lighting control system that is operably coupled to the lighting system of the location of interest. In one embodiment, this interpretation may be achieved by implementing software that is configured to assign a set of lighting commands based on the sensor from which the information received. These commands may be preprogrammed so that the information is conveyed using a known framework that individuals present in the location will readily understand. For example specific colors can be used to indicate specific types of weather conditions, emergency situations, navigational cues, and location-specific alerts. In one embodiment, the interpretation of informational data sets may be achieved using a signal processor that interprets the lighting commands received from the lighting control system.

The lighting system of the location of interest may then be activated in step 240 in a first lighting pattern. In one embodiment, this activation may be achieved by means of a plurality of decoders, each affixed to a light in the lighting system. Each decoder interprets the lighting command received from the lighting control system and activates the associated light in accordance with the applicable command. In another embodiment, either a DMX 512 network, a DALI (Digital Addressable Lighting Interface) network, or an IoT (internet of things) lighting network may be used.

The first lighting pattern is based on the first set of lighting commands and thereby conveys the information contained in the first informational data set to the individuals present in the location of interest. In one embodiment, the lighting system is configured with LED lights to enable a broad range of colors and patterns to be used to convey a wide range of information. Examples of lighting patterns the may be used may include various colors, pulses, intensities, and durations. The lighting pattern may also be displayed in a dynamic manner, which emulates a moving pathway so as to increase visibility and also to be used in giving navigational cues.

In an embodiment of the present disclosure, the method 200 further comprises collecting and processing a second informational data set. In such an embodiment, the method comprises receiving, at a processor in step 250, a second informational data set from at least one sensor, wherein each sensor is configured to collect information about a location of interest and wherein the information contained in the second informational data set relates to at least one of: a weather condition, an emergency situation, a navigational cue, and a location-specific alert. This second informational data set may be collected at a later point in time than that first informational data set to provide status updates regarding a particular condition to individuals present at the location of interest. For example, if the first informational data set alerted individual as to the presence of a fire and provided navigational cues to provide a means of exit, the second informational data set may update the exit route based on the progress of the fire through the location. If one means of exit becomes blocked, the navigational cues may be updated to update the safest exit route. In a more benign example, if the first informational data set conveyed information that an airport gate was closed, the second informational data set can alert passengers traveling through the airport that the flight is actively boarding.

Once the second informational data set is received, it can be interpreted in step 260 to generate a second set of lighting commands. This second set of lighting commands may then be transmitted in step 270 to the lighting control system to activate the lighting system in in the location of interest in a second lighting pattern in step 280. In one embodiment, the second lighting pattern is different from the first lighting pattern to thereby convey additional, real-time information to individuals present in the location related to a change in status of at least one of: the weather condition, the emergency situation, the navigational cue, and the location-specific alert.

The present disclosure contemplates scenarios where the lighting system of the entire location of interest may be activated in the same manner because the information being conveyed is relevant to all individuals in all parts of the same location. However, in other embodiments, the lighting systems of different areas of the location of interest may be activated differently or not activated at all depending on the nature of the information being conveyed. For example, in the event of a fire, the lighting system may be activated differently at various areas of the location of interest depending on where the fire is, ensuring that individuals at these various areas are all provided with a safe means of exit. In a non-emergency example, the lighting system of an airport may be activated differently to inform travelers of those gates that are actively boarding or those gates that are currently closed.

A key advantage of the present method over the prior art is that it may be configured to continuously collect informational data sets from multiple sensors, either simultaneously or sequentially, over a period of time to thereby adjust the activation of the lighting system accordingly to provide real-time updates to individuals present at the particular location.

The method is also advantageous because it does not depend on the use of a mobile device or other electronics that not all individuals (especially young children, hospital patients, or residents of nursing or personal care homes) have access to. The method is implemented using a location's existing sensor systems and lighting systems and hardware which are fitted with LED lights. Therefore, there is no need to install additional displays or signage at a location of interest. This not only saves time and money by avoiding construction costs but also aids in securing the location because obvious emergency displays may be easily disarmed by threat actors. Relying on an existing lighting system provides a discrete and effective means of providing information during an emergency. Such an approach also enables a fully self-contained system that does not rely on input or output feeds to any external location or other device. Since all of the information is collected and received locally, there is no need for any cloud storage. Further, the present disclosure contemplates deploying the system and method disclosed herein so that there is redundancy in the design. This means that if one portion of the lighting activation goes down, others may be engaged to provide the information.

Figure 3:
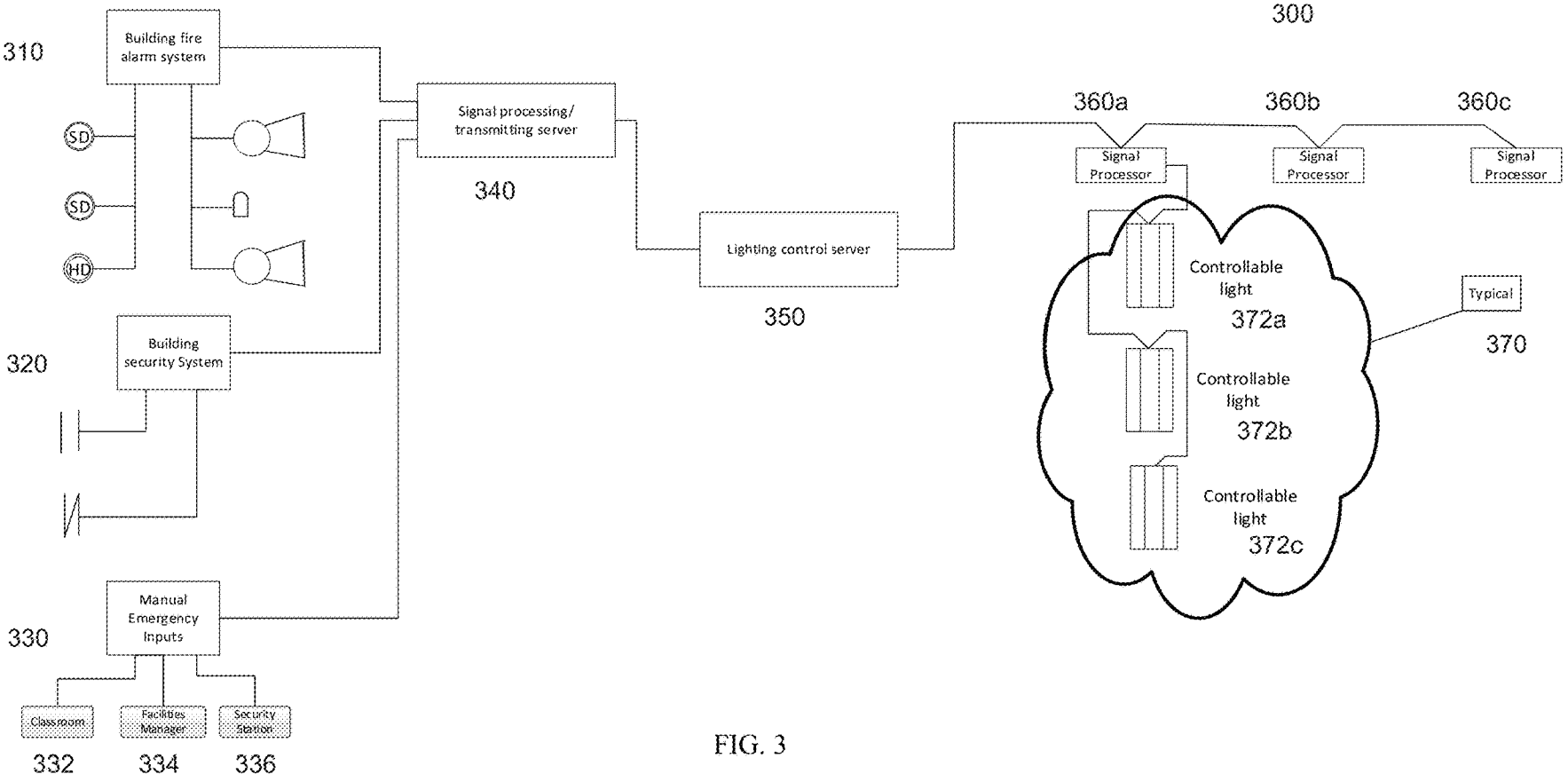
FIG. 3 is illustrative of a system of the present disclosure.

The present disclosure also provides for a system for adaptive wayfinding, one embodiment of which is illustrated in FIG. 3. The system 300 may comprise at least one sensor configured to collect at least one informational data set about a location of interest. The embodiment of FIG. 3 comprises three different systems with multiple sensors per system that are operably connected and the location of interest illustrated is a school. These systems, with their respective sensors, include a building fire alarm system 310, a building security system 320, and manual emergency inputs 330. These manual emergency inputs further comprise inputs from a classroom 332, a facilities manager 334, and a security station 336. The sensors may be affixed to various areas of the location of interest to ensure valuable information is obtained from multiple locations. Being able to gather real time information from these multiple locations not only provides for a more complete set of information about any given scenario but also enables the system to react to changes in the status of these scenarios over time.

These systems and their respective sensors are operably coupled to a processor (illustrated as a signal processing/transmitting server 340) that is configured to receive the various informational data sets and interpret the informational data sets to generate at least one set of lighting controls. The lighting controls, which are essentially a set of scene commands, are sent to a lighting control system (illustrated as a lighting control server 350). At least one signal processor (360*a*, 360*b*, 360*c*) may be configured to receive each set of lighting commands from the lighting control system and execute each lighting command to thereby activate a lighting system in the location of interest.

As illustrated in FIG. 3, each signal processor (360*a*, 360*b*, 360*c*) may be operably coupled to one or more lights (372*a*, 372*b*, 372*c*), which may be LEDs, in the lighting system 370 to thereby active each light in accordance with the applicable lighting commands. In one embodiment, each light (372*a*, 372*b*, 372*c*) may be further configured with a decoder or digital processor that interprets the lighting commands received from the lighting control system and activates the light in accordance with the command.

FIGS. 4-13 illustrate various embodiments of the present disclosure and are representative of a few of the locations of interest the system and method of the present disclosure may be deployed in. These embodiments are provided for exemplary purposes and are not intended to limit the present disclosure to only these illustrated embodiments.

Figure 4:
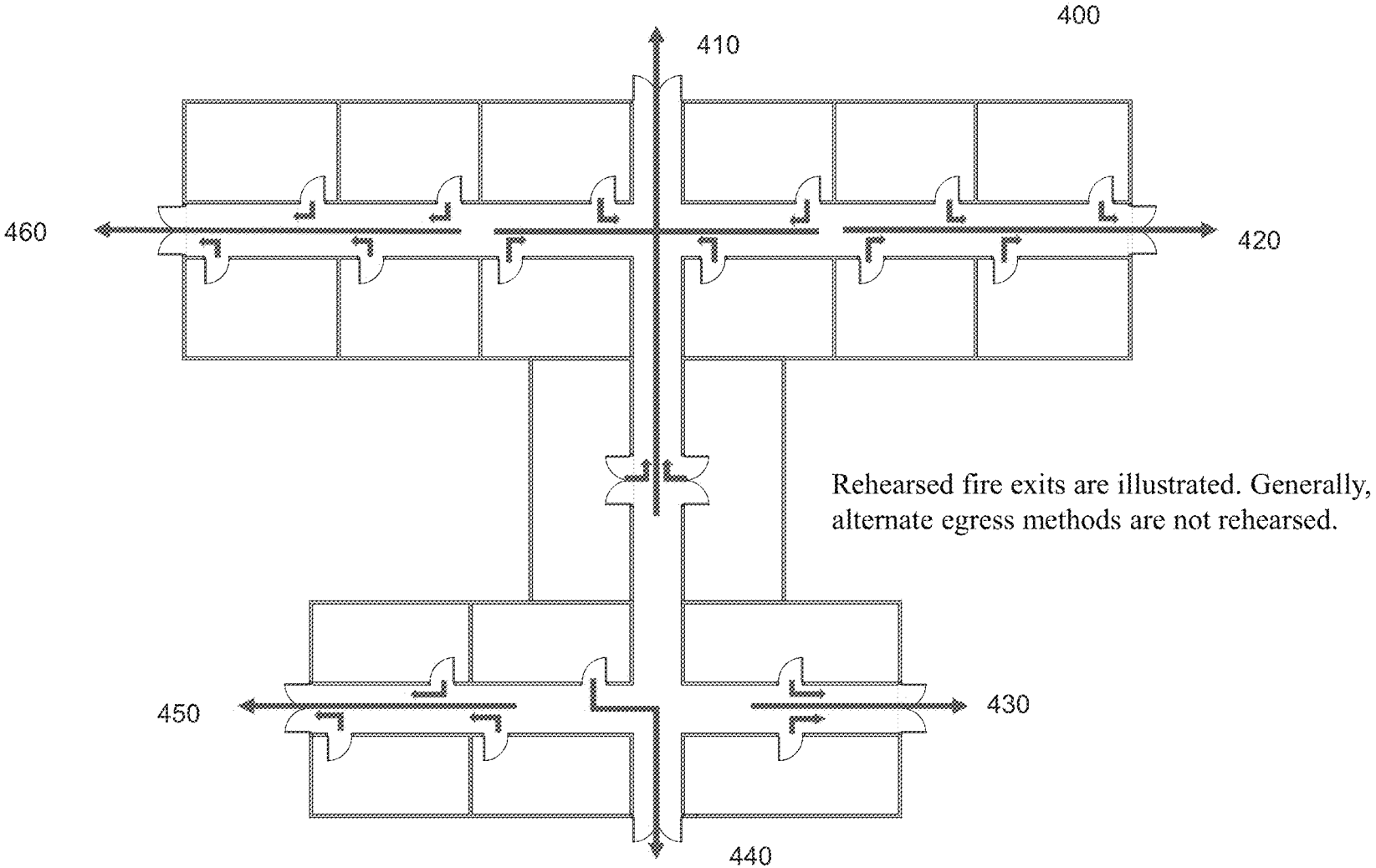
FIG. 4 is illustrative of a typical fire exit route.
Figure 5:
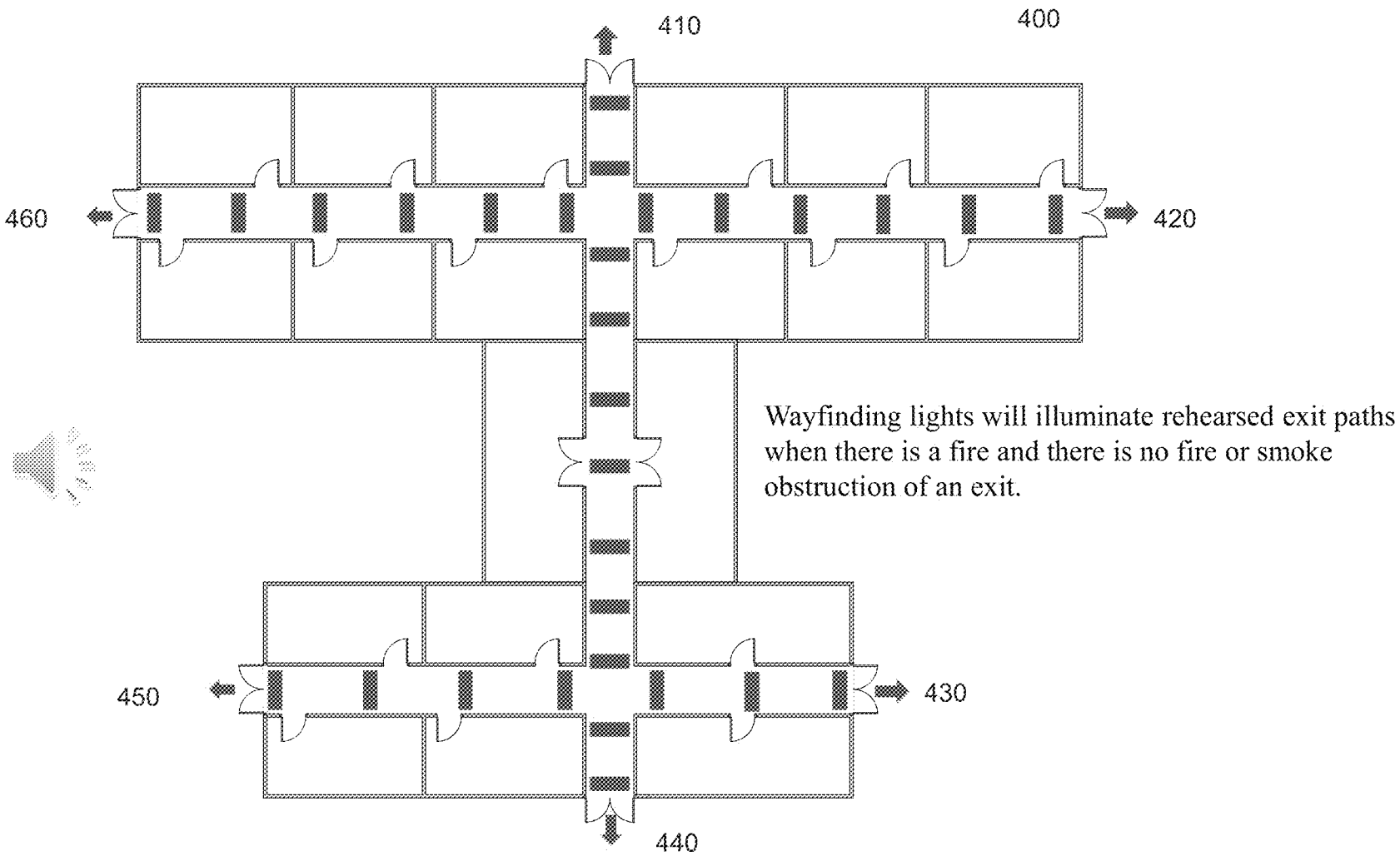
FIG. 5 is illustrative of illustrative of the system and method of the present disclosure that utilizes dynamic data inputs based on current conditions and wayfinding lights to illuminate an exit and route that is safe for individuals to use.
Figure 6:
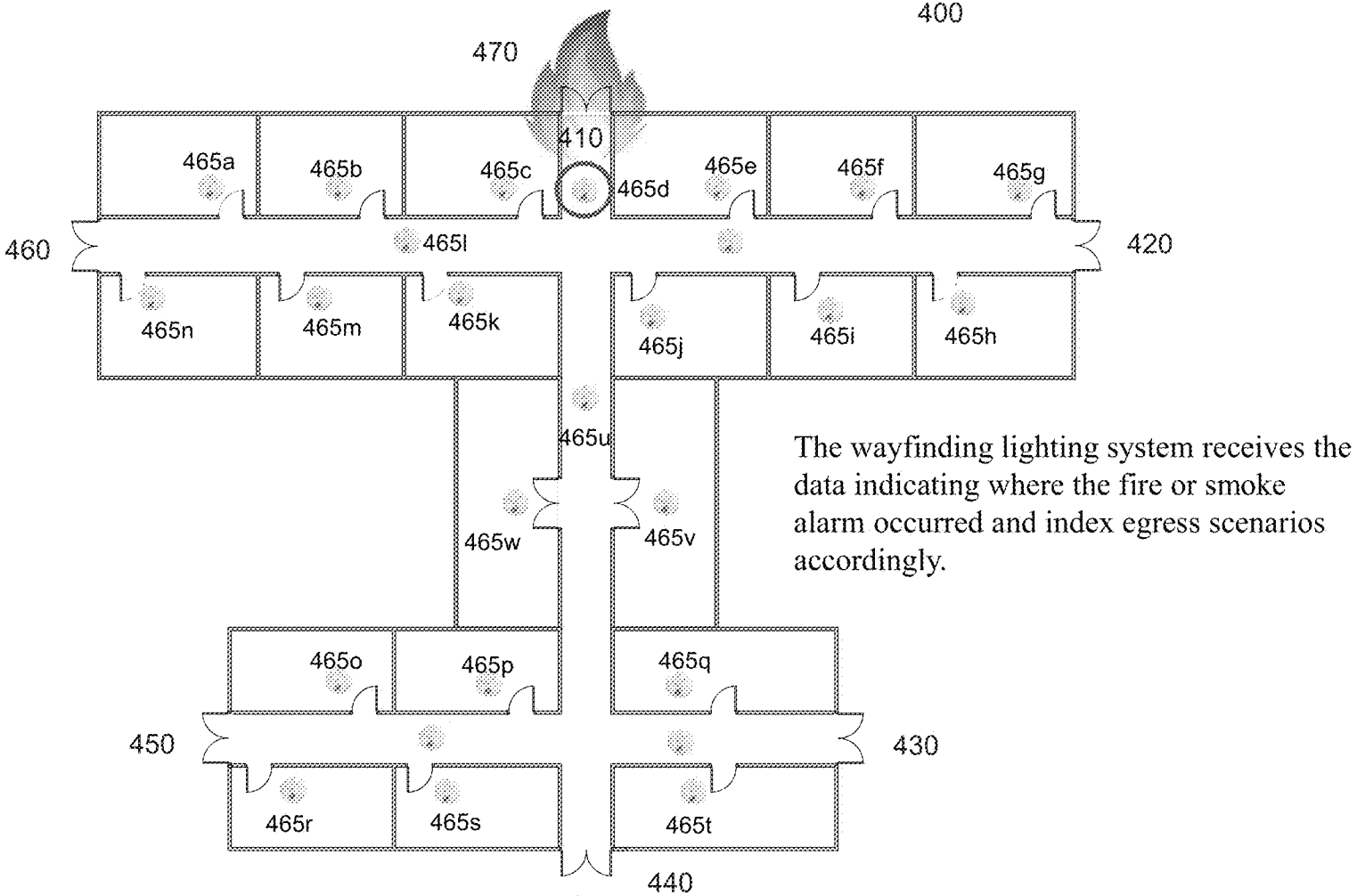
FIG. 6 is illustrative of multiple data inputs/sensors that may be deployed throughout a given environment to relay information on current conditions at various locations throughout that environment.
Figure 7:
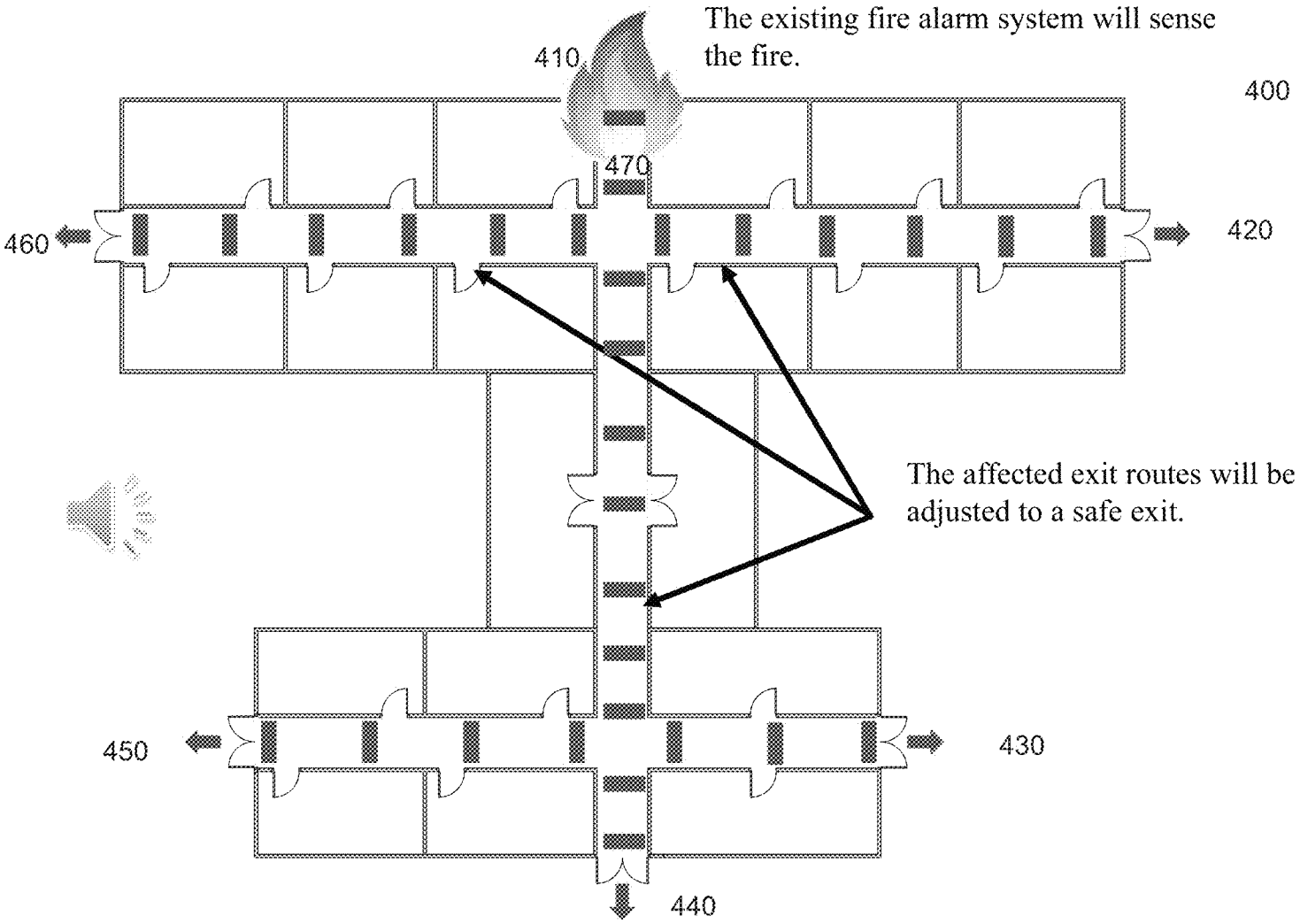
FIG. 7 is illustrative of the dynamic nature of the system and method of the present disclosure. The illuminated exit route can be adjusted based on the location of the fire or other emergency.

FIGS. 4-7 illustrate the advantages the system and method of the present disclosure have over the prior art when there is a fire in the location of interest. FIG. 4 illustrates the current state of the art, where one predetermined escape route in a location of interest 400 is determined and practiced. In FIG. 4, the means of exit (410, 420, 430, 440, 450, and 460) are illustrated. The predetermined route assumes that none of the exits (410, 420, 430, 440, 450, and 460) will be blocked. FIG. 5 illustrates how the predetermined escape route may be illuminated in the event of a fire. Here, adaptive wayfinding is used to illuminate the predetermined route to escort individuals exiting the location of interest via the various exits (410, 420, 430, 440, 450, and 460). However, FIG. 6 illustrates the benefits of the adaptive wayfinding of the present disclosure, where sensors (illustrated as 465*a*-465*w*) affixed to various areas within the location of interest 400 collect informational data sets about the fire emergency. As can be seen from FIG. 6, the predetermined escape route via exit 410 is blocked by the fire 470. Existing addressable building wide smoke/heat detectors are typically installed as part of the fire alarm system. The fire system signals will be used to initiate the wayfinding lighting through an independent data stream. Existing fire alarm system and operation is not affected. The adaptive wayfinding method described herein will locate the fire 470 and reroute the escape route to provide for a safe means of exit that avoids the fire 470 and exit 410. This adapted route is illustrated in FIG. 7. Here, the exit routes are re-routed to avoid the fire 470 and the exit 470.

Figure 8:
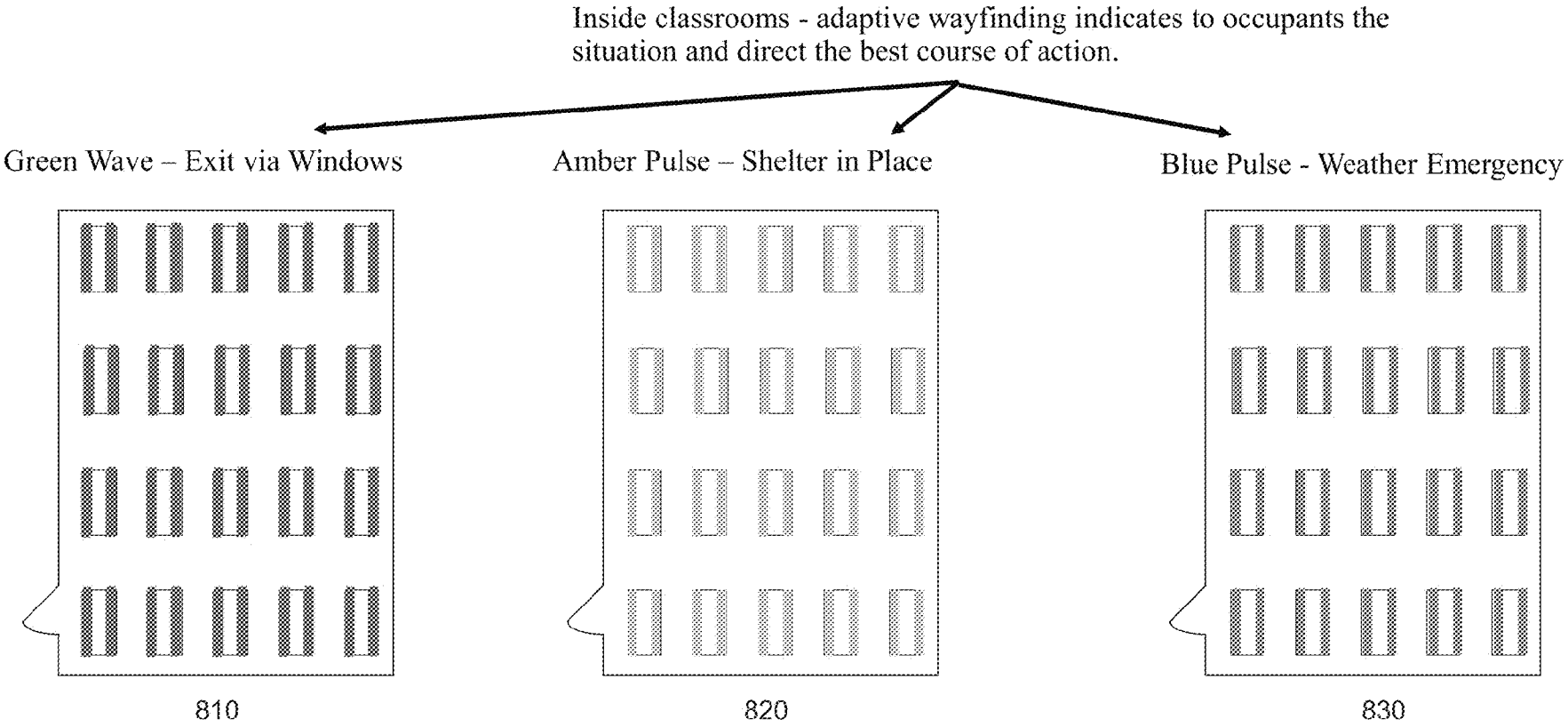
FIG. 8 is illustrative of exemplary signals that can be programmed using the lighting control system when deployed in a school environment.

FIG. 8 illustrates the advantages the system and method of the present disclosure have over the prior art when there is an emergency in a school. For example, in an active shooter scenario, a building's sensors and systems may collect information, either automatically based on security systems or manually based in inputs from teachers or other administrators in the building, about the location and/or path of the shooter. The lighting system may be activated to provide instructions to the individuals in the school based on their location. Each classroom or other area of the school may thereby receive customized lighting activations to ensure they have the best information to assist them based on their location, which may include lighting cues such as shelter in place or specify the egress path away from the threat. As seen in FIG. 8, different lighting patterns using a combination of colors and pulses may be used to convey instructions to individuals. For example, a green wave may indicate that the students and teachers should evacuate via the classroom windows because exiting through the classroom door is unsafe 810. An amber pulse may indicate that the students and teachers should shelter in place because that is the safest place for them given the location and/or path of the shooter 820. In other scenarios related to weather conditions, a blue pulse may indicate a particular type of weather emergency 830. These weather alerts are particularly advantageous in areas where tornadoes, earthquakes, flash floods, and other weather events may happen with little to no advanced warning. The use of adaptive wayfinding provides an intelligent alert to the students, and teachers, as well as staff and visitors, avoiding additional panic or chaos that may occur in the event of an emergency. Adaptive wayfinding also enables more individuals to find a safe location in an emergency that provided for using current alarm methods. Adaptive wayfinding provides information which is intuitive for visitors and occupants who may be unfamiliar with the building as well, by lighting a path or direction of egress which they may not have practiced or otherwise be familiar with.

Figure 9:
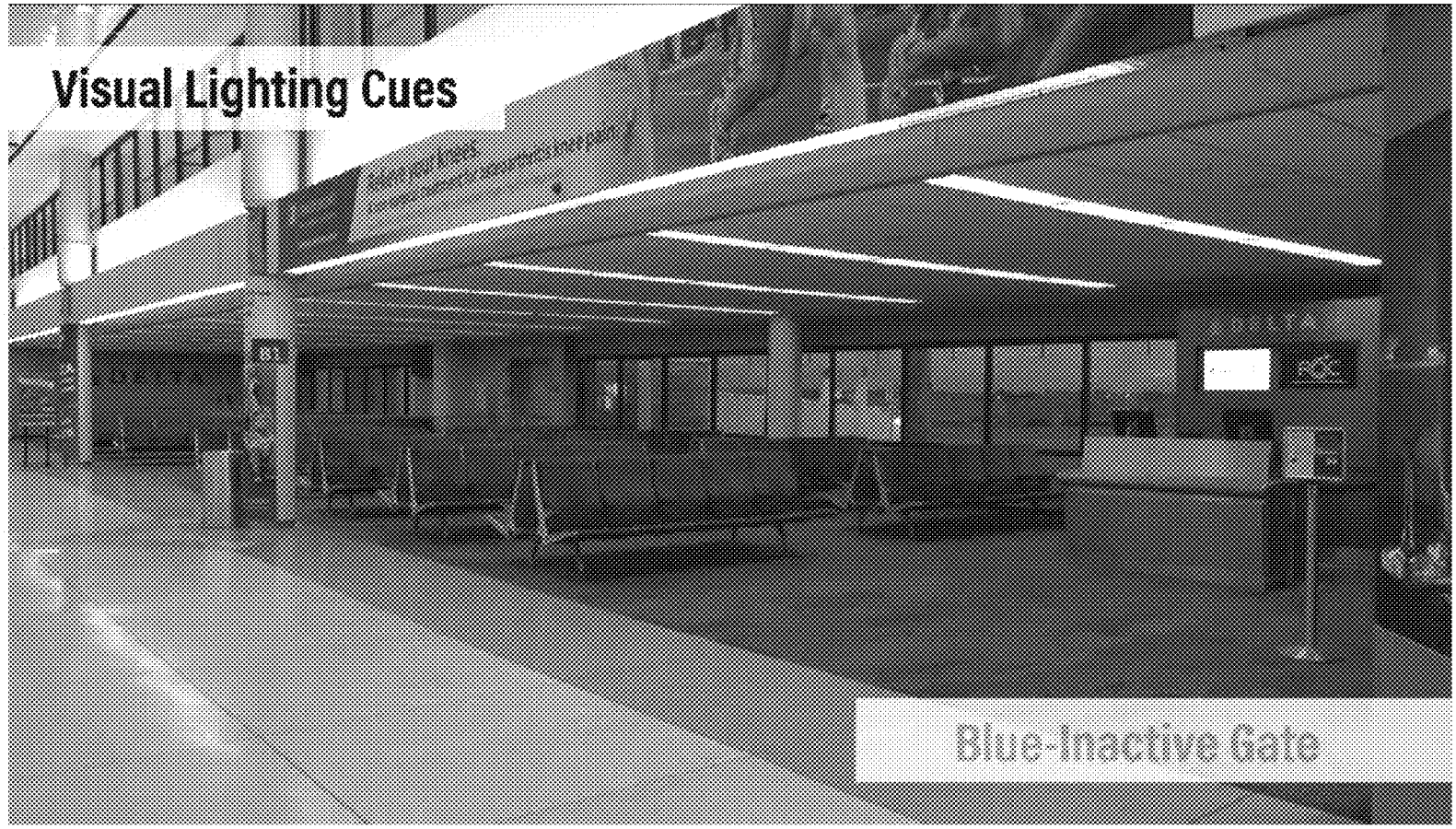
FIG. 9 is illustrative of exemplary signals that can be programmed using the lighting control system when deployed in an airport environment.
Figure 10:
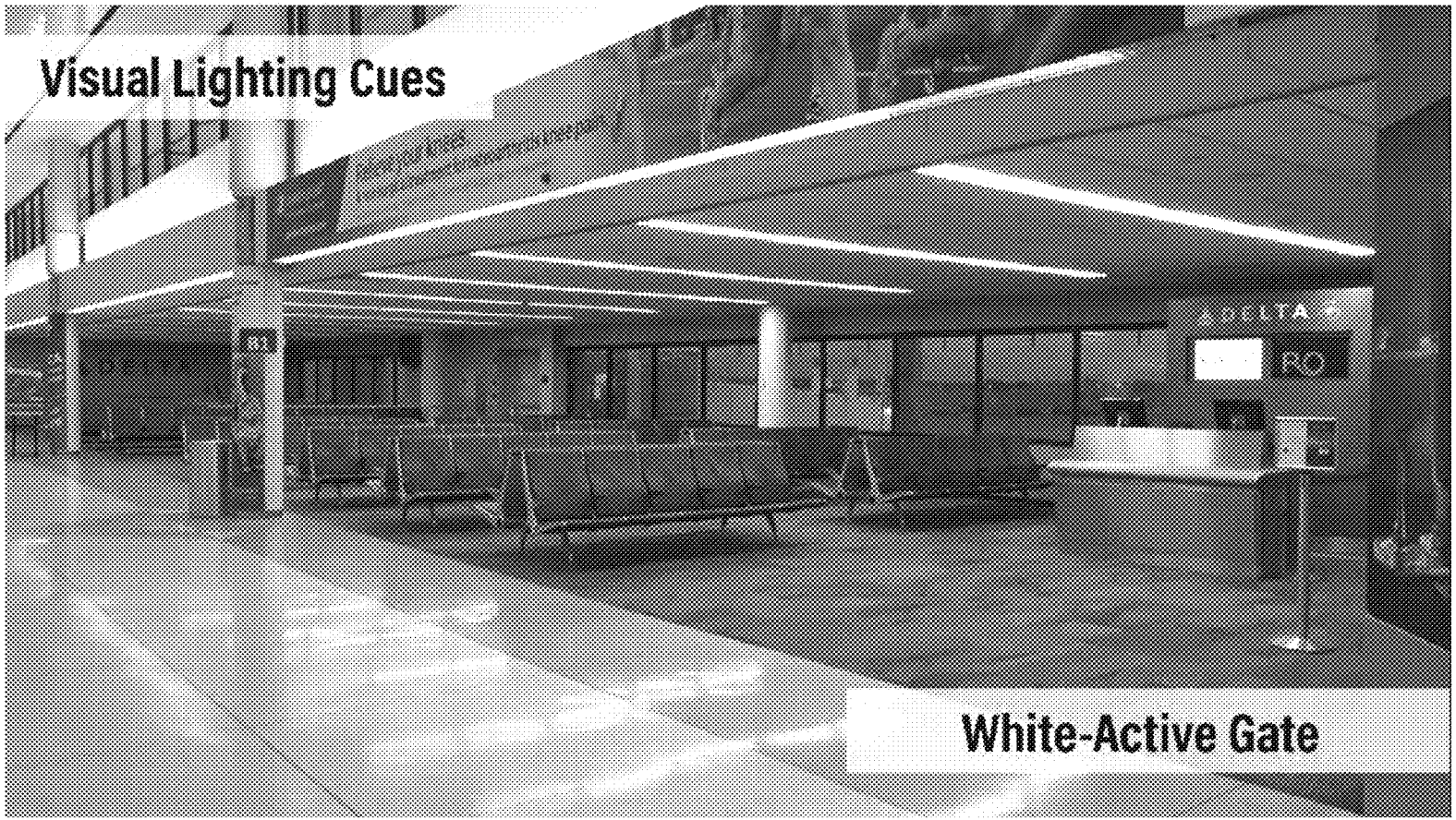
FIG. 10 is illustrative of exemplary signals that can be programmed using the lighting control system when deployed in an airport environment.
Figure 11:
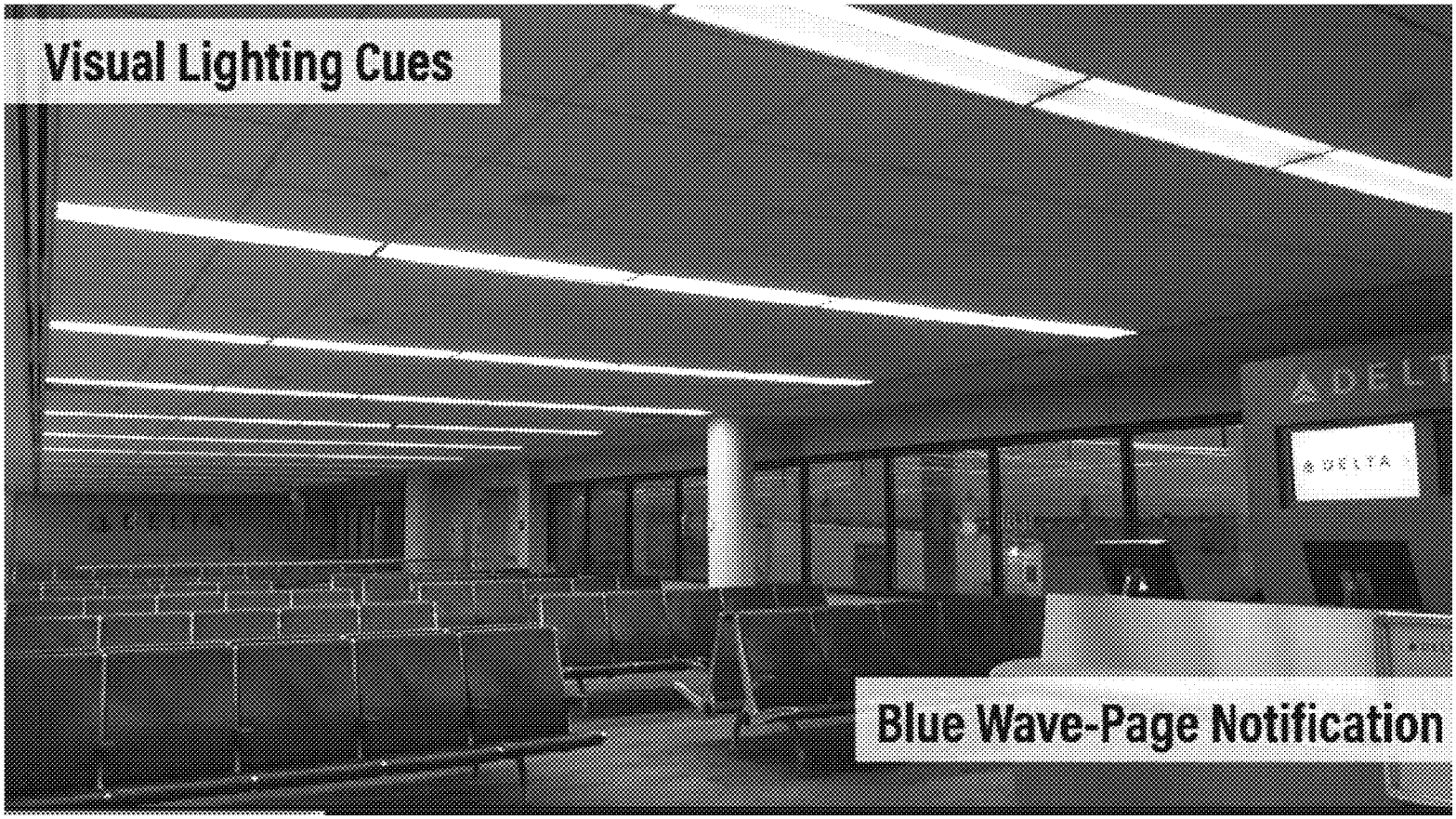
FIG. 11 is illustrative of exemplary signals that can be programmed using the lighting control system when deployed in an airport environment.
Figure 12:
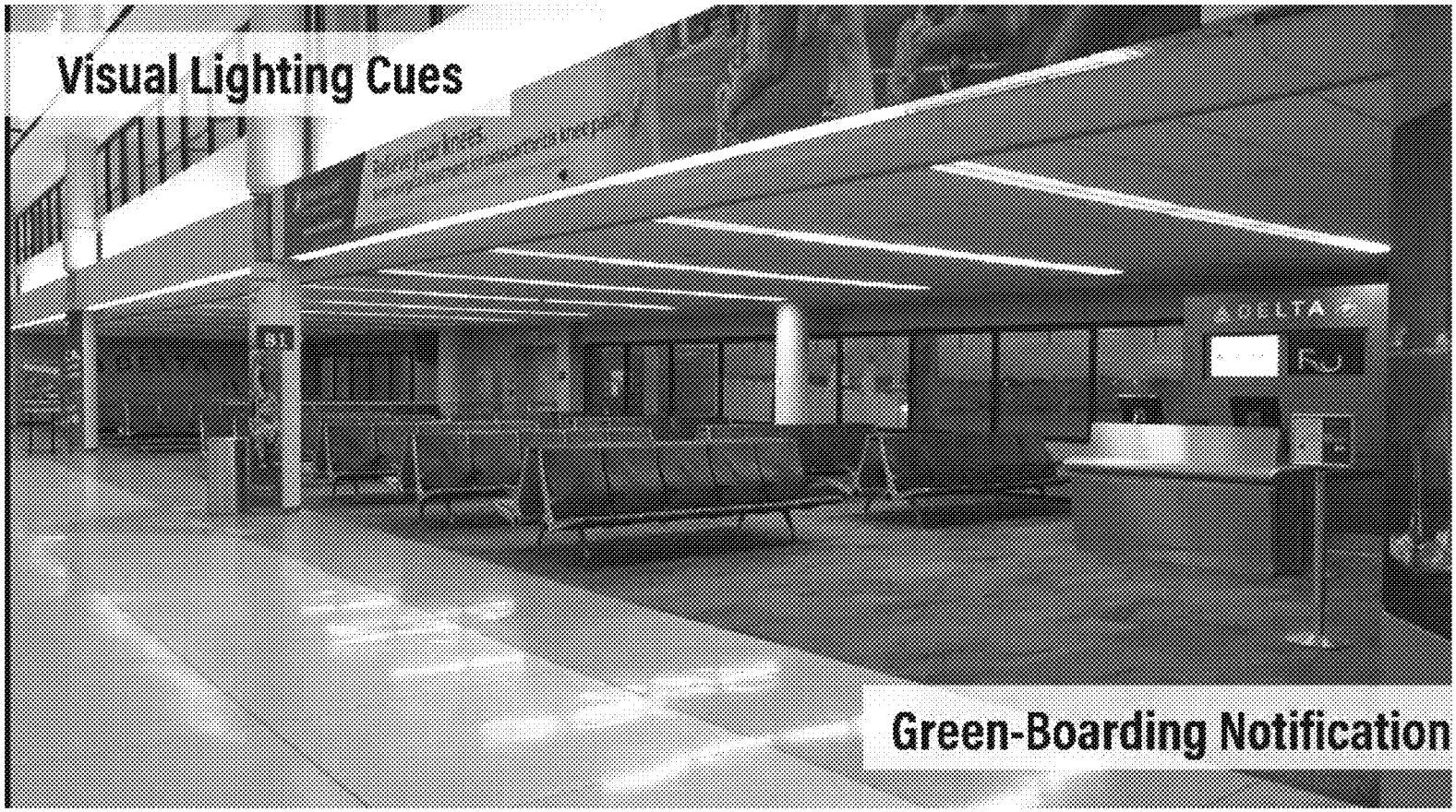
FIG. 12 is illustrative of exemplary signals that can be programmed using the lighting control system when deployed in an airport environment.
Figure 13:
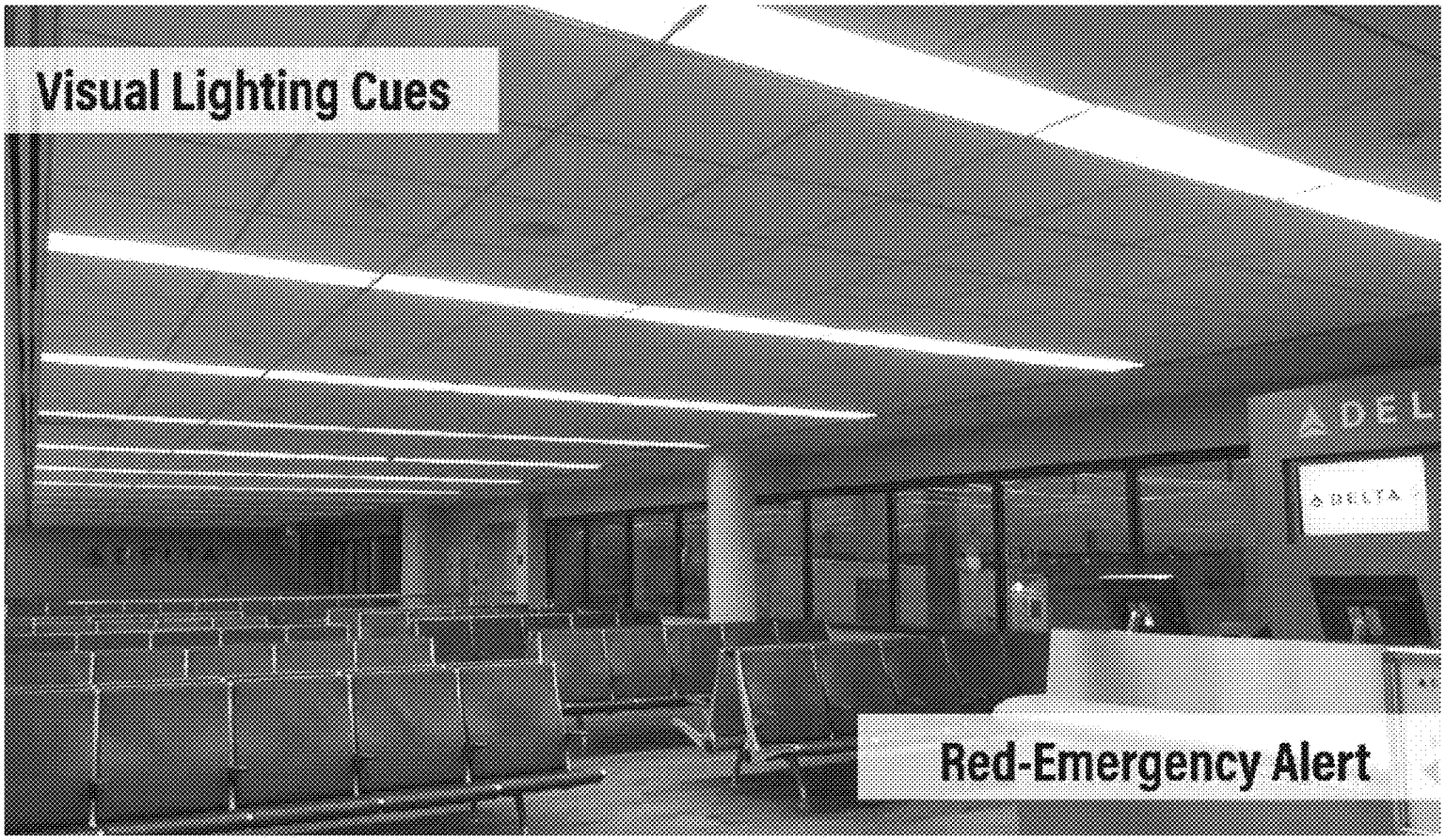
FIG. 13 is illustrative of exemplary signals that can be programmed using the lighting control system when deployed in an airport environment.

FIGS. 9-13 illustrate the advantages the system and method of the present disclosure have over the prior art when giving location-specific alerts. The scenario illustrated in FIGS. 9-13 is an airport, but the same methodology will apply in any venue that needs to move a large number of individuals from one location to another. As seen in FIGS. 9-13 different lighting patterns, including a combination of colors, pulses, and durations create both static and dynamic lighting activations, each indicating a different location-specific alert. In FIG. 9, a static blue lighting activation indicates an inactive gate. The lighting activation is changed in FIG. 10 to indicate that the gate is now open. When an announcement is made, for example when paging a passenger, a dynamic blue lighting activation can be used. This activation is illustrated in FIG. 11. As can be seen from FIG. 11 such an activation holds potential for alerting those individuals with hearing impairment and other disabilities that an announcement is being made. When the flight is boarding, a green lighting activation can be used as illustrated in FIG. 12. In the event of an emergency, a dynamic red lighting activation can be implemented as illustrated in FIG. 13.

Although the disclosure is described using illustrative embodiments provided herein, it should be understood that the principles of the disclosure are not limited thereto and may include modification thereto and permutations thereof.

What is claimed is:

1. A method comprising:

receiving, at a processor, a first informational data set from at least one sensor, wherein each sensor is configured to collect information about a location of interest and wherein the information contained in the first informational data set relates to at least one of: a weather condition, an emergency situation, a navigational cue, and a location-specific alert;

interpreting the first informational data set to thereby generate a first set of lighting commands;

transmitting the first set of lighting commands to a lighting control system, wherein the lighting control system is operably coupled to the lighting system of the location of interest;

activating the lighting system of the location of interest in a first lighting pattern based on the first set of lighting commands to thereby convey the information contained in the first informational data set to individuals present in the location;

receiving, at a processor, a second informational data set from at least one sensor, wherein each sensor is configured to collect information about a location of interest and wherein the information contained in the second informational data set relates to at least one of: a weather condition, an emergency situation, a navigational cue, and a location-specific alert and is collected at a point in time which is later than the point in time the first informational data set was collected;

interpreting the second informational data set to thereby generate a second set of lighting commands;

transmitting the second set of lighting commands to the lighting control system; and activating the lighting system of the location of interest in a second lighting pattern based on the second set of lighting commands to thereby convey the information contained in the second informational data set to individuals present in the location, wherein the second lighting pattern is different from the first lighting pattern and wherein the change from the first lighting pattern to the second lighting pattern conveys additional real-time information to the individuals present in the location relating to a change in status of at least one of the weather condition, the emergency situation, the navigational cue, and the location-specific alert.

2. The method of claim 1 wherein at least one of the first lighting pattern and the second lighting pattern are further configured to operate in a dynamic manner.

3. The method of claim 2 wherein at least one of the first lighting pattern and the second lighting pattern, when configured to operate in a dynamic manner, are further configured to provide dynamic navigational cues to individuals present in the location of interest to lead the individuals to a safe route of exit.

4. The method of claim 2 wherein the route is determined in real-time based on the location of a particular threat, wherein such route and the location of the threat are further determined based on at least one of the informational data sets received from at least one sensor.

5. The method of claim 1 wherein the navigational cue further comprises instructions to shelter in place.

6. The method of claim 1 wherein the location of interest further comprises at least one of: an airport, a subway system, a ground transportation terminal, a port, a theater, a sports venue, a school, an office building, a hospital, an industrial facility, a manufacturing facility, a long term care facility, physician offices, a day care, religious buildings, a government building, and a shopping mall.

7. The method of claim 1 wherein the informational data set further comprises a set of manual inputs.

8. The method of claim 7 wherein the manual inputs may be applied by at least one of: a first responder and an authorized individual present at the location of interest.

9. The method of claim 1 wherein the lighting system further comprises a plurality of LED lights.

10. The method of claim 1 wherein the sensor further comprises at least one of: a security system, a fire alarm system, a building management system, a paging system, elevator controls, motion detectors, threat detectors, metal detectors, luggage scanners, gunfire location system, gunfire detection system, body scanners, thermostats, HVAC control panels, and computer networks.

11. The method of claim 1 wherein at least one of the first and second lighting patterns further comprise one or more colors wherein each color is indicative of at least one of: a specific weather condition, a specific emergency situation, a specific navigational cue, and a specific situational indicator.

12. The method of claim 1 wherein the lighting system is further activated using at least one signal processor, wherein the signal processor interprets the lighting commands received from the lighting control system.

13. The method of claim 1 wherein the lighting system of the location of interest is further activated by means of at least one of a decoder and a receiver that is affixed to each light in the lighting system and is configured to interpret the lighting commands received from the lighting control system and activate the associated light in accordance with the lighting commands.

* * * * *